US005301373A

United States Patent [19]

Hull et al.

[11] Patent Number: 5,301,373

[45] Date of Patent: Apr. 12, 1994

[54] DUAL FLUSH MECHANISM

[75] Inventors: Douglas A. Hull; Randy O. Mesun, both of Sheboygan, Wis.

[73] Assignee: Kohler Co., Kohler, Wis.

[21] Appl. No.: 18,631

[22] Filed: Feb. 17, 1993

[51] Int. Cl.[5] ..... E03D 1/14

[52] U.S. Cl. ..... 4/325; 4/379

[58] Field of Search ..... 4/324, 325, 379, 381, 4/382, 415

[56] References Cited

U.S. PATENT DOCUMENTS

| | | | |
|---|---|---|---|
| 2,754,521 | 7/1956 | Marcum | 4/57 |
| 2,775,772 | 1/1957 | Clarke | 4/67 |
| 3,538,519 | 11/1970 | Weisz | 4/67 |
| 3,561,016 | 2/1971 | Reynolds | 4/67 |
| 3,775,778 | 12/1973 | Lee | 4/67 |
| 3,831,204 | 8/1974 | Cook | 4/57 |
| 3,839,746 | 10/1974 | Kowalski | 4/67 |
| 3,908,203 | 9/1975 | Jackson | 4/67 |
| 4,117,556 | 10/1978 | Semier | 4/325 |
| 4,135,263 | 1/1979 | Anderson | 4/324 |
| 4,160,294 | 7/1979 | Crumby | 4/324 |
| 4,183,107 | 1/1980 | Hare et al. | 4/324 |
| 4,295,488 | 10/1981 | Book | 137/414 |
| 4,328,596 | 5/1982 | Renz | 4/324 |
| 4,351,071 | 9/1982 | Clar | 4/324 |
| 4,406,024 | 9/1983 | Chiu et al. | 4/324 |
| 4,411,029 | 10/1983 | Huang | 4/324 |
| 4,455,694 | 6/1984 | Dymon | 4/325 |
| 4,530,119 | 7/1985 | Chiu et al. | 4/324 |
| 4,969,218 | 11/1990 | Comparetti | 4/325 |
| 5,070,547 | 12/1991 | Comparetti | 4/325 |
| 5,103,507 | 4/1992 | Sprajc et al. | 4/324 |
| 5,153,948 | 10/1992 | Smith et al. | 4/415 |
| 5,157,795 | 10/1992 | Pasquin | 4/324 |
| 5,157,796 | 10/1992 | Boyer | 4/394 |
| 5,175,893 | 1/1993 | Navarrete | 4/326 |
| 5,206,960 | 5/1993 | Hooshley et al. | 4/325 |

*Primary Examiner*—Charles E. Phillips
*Attorney, Agent, or Firm*—Quarles & Brady

[57] ABSTRACT

A flush mechanism for use with a toilet tank is disclosed. The mechanism permits selection between flushing cycles of two different time durations. The tank has a wall with an outlet therein and a valve member. The flush mechanism has a shaft linked at one end to the valve, a float slidably mounted on the shaft, and a cam pivotally connected to the shaft adjacent the float. The cam is rotatable between a short flush position wherein the float is allowed to assume a high position along the shaft and a long flush position wherein the cam member forces the float into a low position along the shaft.

4 Claims, 4 Drawing Sheets

FIG. 1
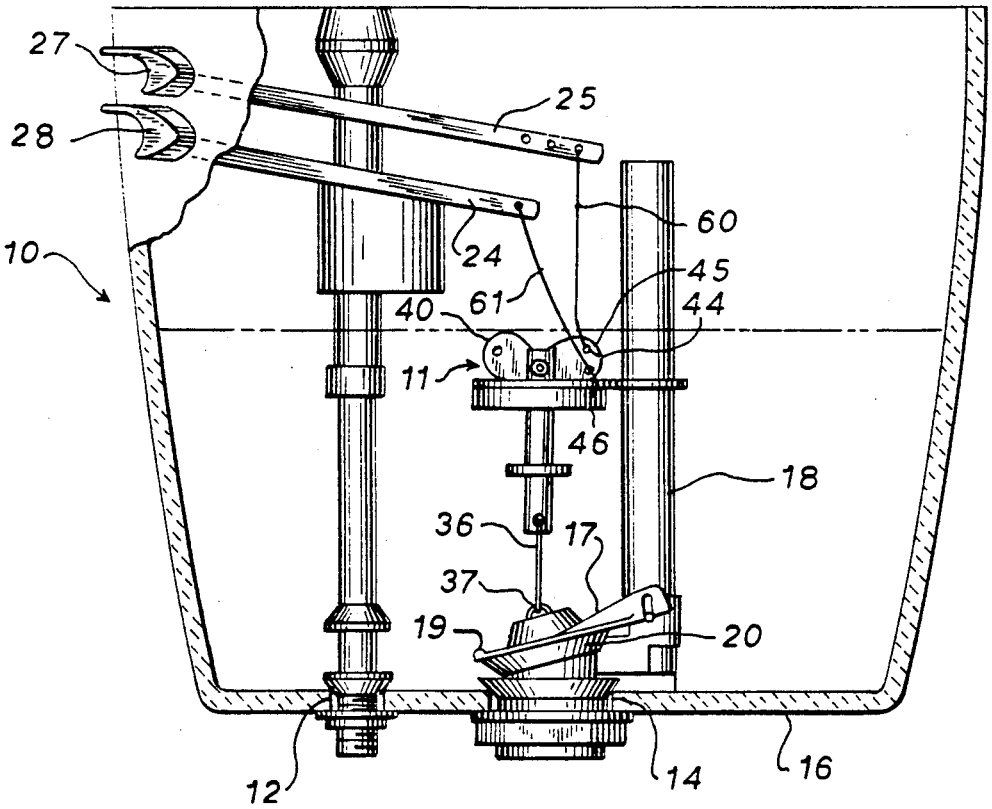
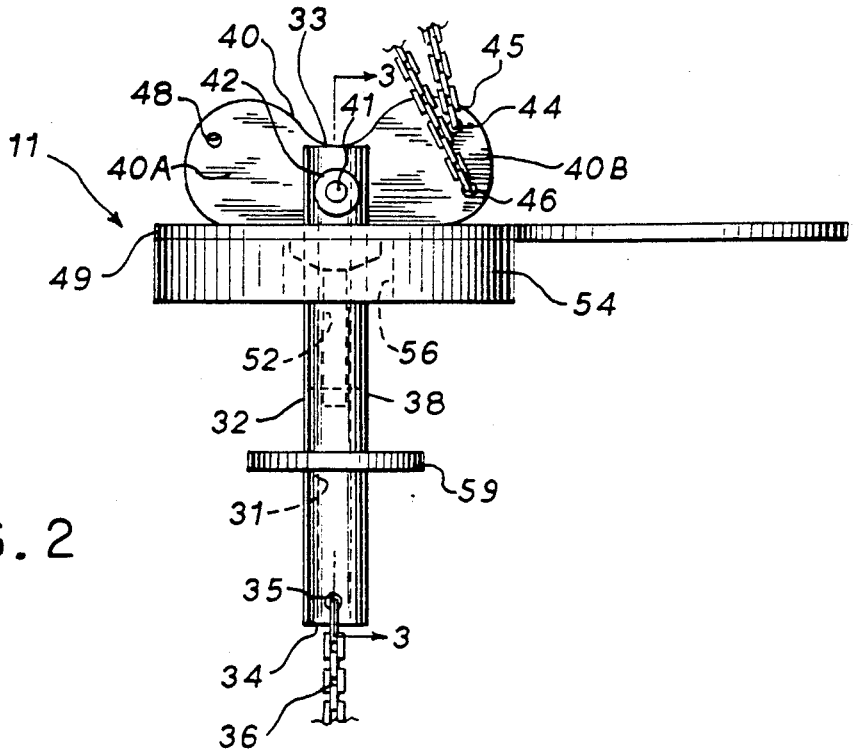
FIG. 2

FIG. 3
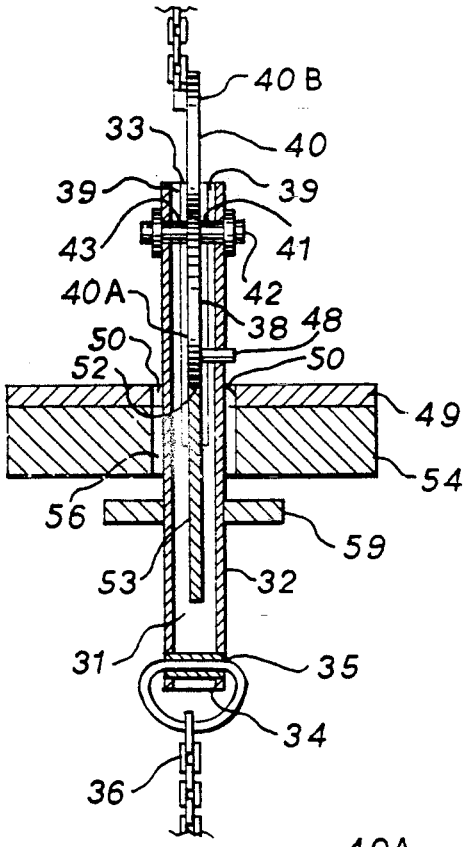
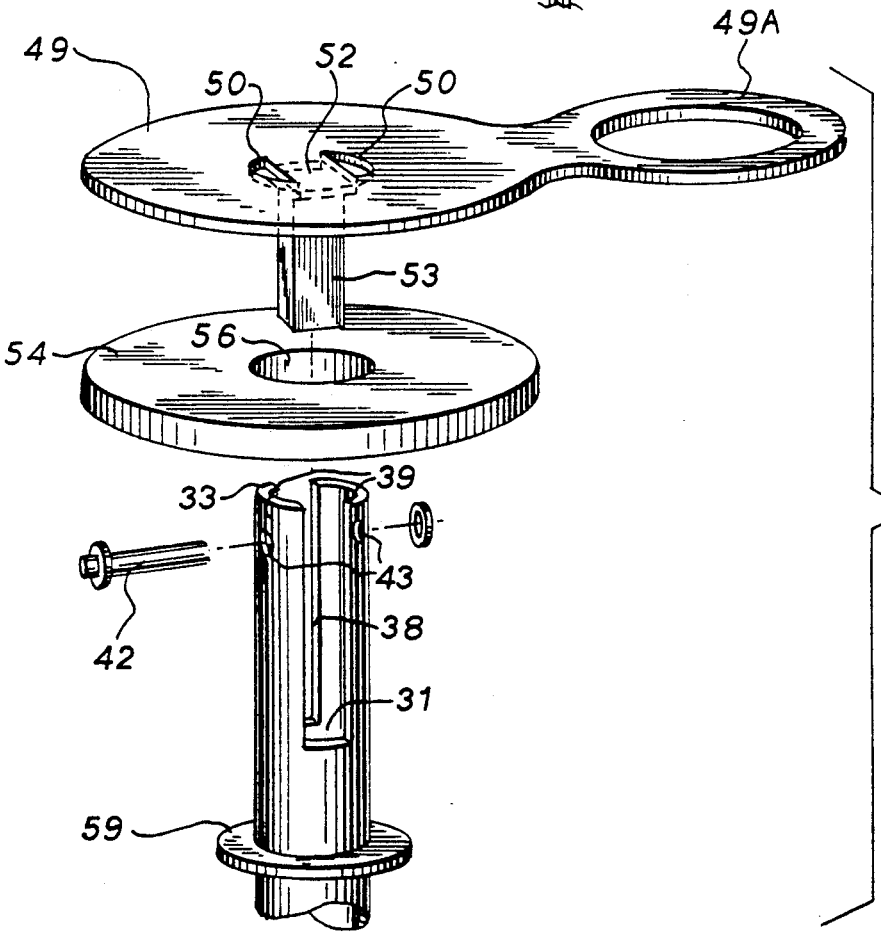
FIG. 4

25
24
60
61
40
40B
62
48
63
49
40A
67
54
68
32
36
19
20
14

25
24
60
61
40
49
40A
48
63
67
65
62
54
32
36
19
20
14

25
24
60
61
40
49
40A
48
67
63
62
54
32
36
19
20
14

FIG. 8
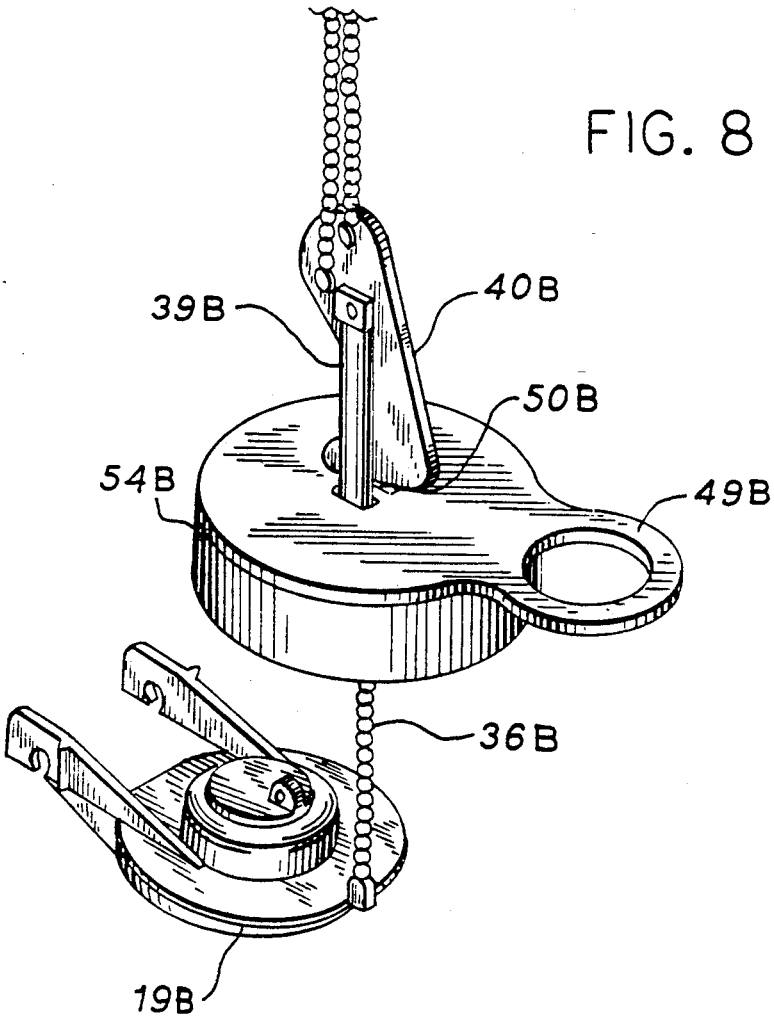
FIG.9
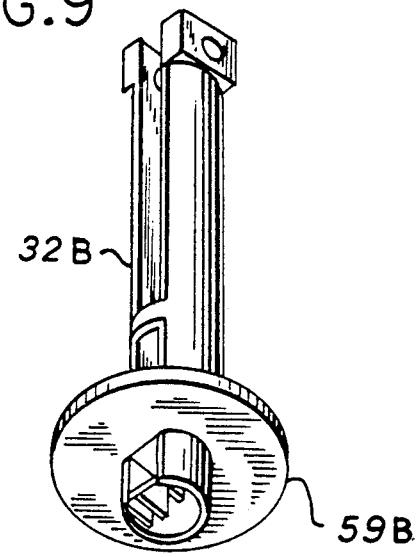
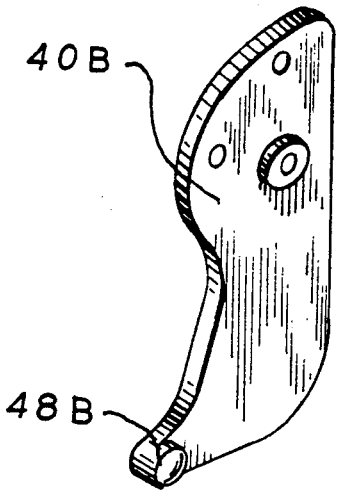
FIG. 10

DUAL FLUSH MECHANISM

FIELD OF THE INVENTION

The present invention relates to a flush mechanism that allows a user to choose between selected flush volumes.

DESCRIPTION OF THE ART

Due to increasing population and limited water supply, conservation of water is becoming important. A significant source of water consumption is the water used in flushing toilets. The art has recognized that in some cases a full volume flush is not required to clean out a toilet bowl (e.g. urine and small amounts of paper only). Thus, many toilets that are designed to remove heavy amounts of feces and paper will waste water when faced with much lighter loads.

The art has therefore developed toilets that use less water during certain flush cycles. However, such devices often require complex and/or expensive mechanisms, and/or are hard to operate due to poor leverage characteristics of the actuating mechanism. In addition, some such devices require continued attention by the user after an initial activation to effect different flushing volumes or an additional deactivation control to terminate a long flushing cycle prematurely.

Also, some such devices include parts which are arranged in a manner wherein lateral forces are exerted on cooperating parts in a manner to cause poor seating of the valve for stopping the flow of water at the termination of a flushing cycle. A further problem has been component wear between adjacent moving parts, which results in poor operation and requires periodic mandatory readjustment of the relative positions of the cooperating parts of the device. Thus, a need exists for an improved, low cost, and reliable mechanism for creating a dual flush toilet.

SUMMARY OF THE INVENTION

The present invention resides in a dual flush mechanism to be used in conjunction with a toilet tank. In one embodiment there is a flush mechanism for use with a toilet tank so as to permit selection between two different toilet tank flush cycles, the tank being of the type having a wall with an outlet therein and a valve member for opening and closing the outlet.

The flush mechanism comprises a shaft linked at one end to the valve member, a float slidably mounted on the shaft, a cam pivotally connected to the shaft adjacent the float, the cam being rotatable between a short flush position wherein the cam allows the float to assume a high position along the shaft and a long flush longitudinal position wherein the cam member forces the float into a low position along the shaft.

A first linkage is connected to the cam at a first location and a second linkage is connected to the cam at a second location. A first activation means is connected to the first linkage and a second activation means is connected to the second linkage, the first activation means being capable of moving the first linkage thereby allowing the cam to assume the short flush lateral position, and the second activation means being capable of moving the second linkage thereby rotating the cam into the long flush position.

In one aspect the flush mechanism includes a float stop disposed below the float on the shaft to limit the downward longitudinal movement of the float along the shaft. In another aspect, the flush mechanism includes a cam projection positioned on the cam so as to contact the shaft upon a long flush activation and thereby limit further rotation of the cam. In yet another embodiment a short flush activation of the cam will, if the last flush was a short flush, cause the cam to rotate in one direction and then automatically rock back in the opposite direction.

The present invention therefore allows a user to choose between two different volume toilet flushes by activating one of two activation members. Once activated, the flush mechanism operates to effect a flush producing the chosen volume and automatically close the valve thereafter. The flush mechanism does not require additional attention after an initial flush activation. Moreover, the components of the flush mechanism are simple and do not require periodic adjustment to operate properly.

The objects of the invention therefore include providing a flush mechanism of the above kind:

(a) which is useful for saving water when only a light waste load is present in the toilet bowl;

(b) that does not require continued user attention after activation; and (c) which is relatively inexpensive to produce and install, and which has simple and durable components.

These and still other objects and advantages of the present invention will be apparent from the description which follows. In the description, the preferred embodiments of the invention will be described with reference to the accompanying drawings. These embodiments do not represent the full scope of the invention. Rather, the invention may be employed in other embodiments. Reference should, therefore, be made to the claims to interpret the breadth of the invention.

BRIEF DESCRIPTION OF THE DRAWINGS

FIG. 1 is a view of a toilet tank partially in section, in which has been installed a flush mechanism embodying the present invention;

FIG. 2 is an enlarged elevational view of the flush mechanism embodying the present invention;

FIG. 3 is a partial cross sectional view of the flush mechanism, taken along line 3—3 of FIG. 2, albeit in which the cam is in a long flush position;

FIG. 4 is an enlarged exploded view showing the follower disk, float and the upper portion of the shaft;

FIG. 8 is a perspective view of a second embodiment of the invention;

FIG. 9 is a perspective view of a shaft of the FIG. 8 embodiment; and

FIG. 10 is a perspective view of a cam of the FIG. 8 embodiment.

DESCRIPTION OF THE PREFERRED EMBODIMENTS

Figure 7:
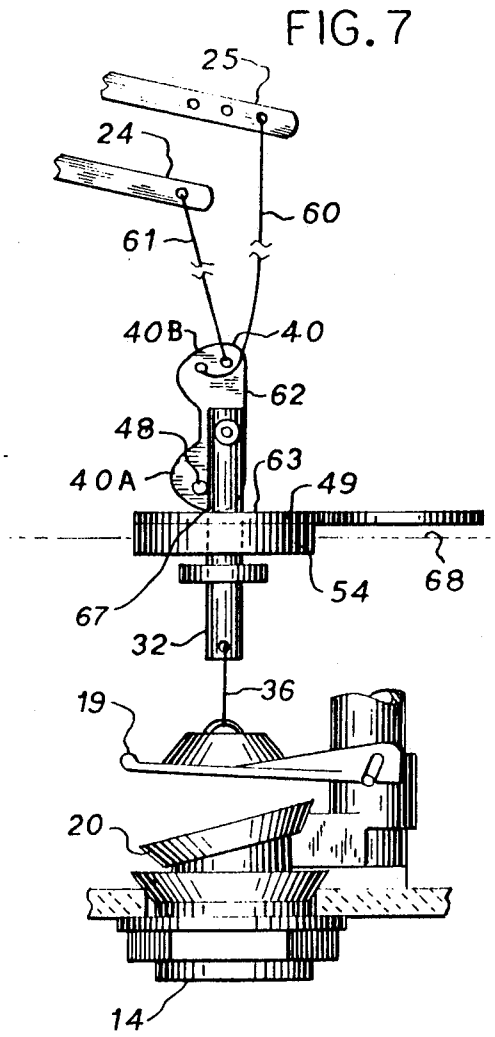
FIG. 7 is a front elevational view of the flush mechanism in a long flush activated state.

Referring to FIG. 1 of the drawings, a toilet tank 10 is shown in which has been installed the dual flush cam assembly 11 of the present invention. The tank 10 has usual inlet hole 12 and an outlet hole 14 formed in its bottom wall 16.

Figure 5:
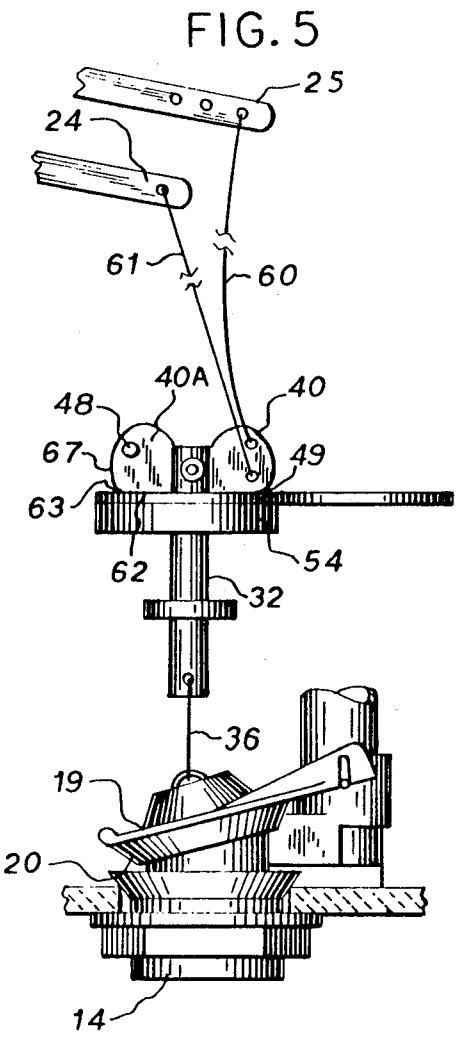
FIG. 5 is a schematic view of the flush mechanism in an unactivated (closed state)

A flush valve assembly, referred to generally by numeral 17, includes a conventional overflow tube 18 and a non-buoyant flapper valve 19 attached near the bottom of the tube 18 for pivotal motion between a closed state wherein the flapper valve 19 rests on a valve seat 20, and an open state wherein, the flapper valve 19 is suspended above the valve seat 20 (see e.g. FIG. 5).

The cam assembly 11 is disposed between the flapper valve 19 and two flush trip arms, one long flush trip arm 24 and one short flush trip arm 25. The short flush trip arm 25 is tripped by a first handle 27 and the flush trip arm 24 is tripped by a second handle 28. Each handle 27, 28 is mounted for pivotal movement on an outside wall 30 of the tank 10.

In the alternative, a single hole can be provided in a tank side wall, and the actuators for the trip arms 24 and 25 can be concentrically arranged through the wall (see e.g. U.S. Pat. No. 4,411,029). Referring now to FIG. 2, the cam assembly 11 has a cylindrical shaft 32 with a hollowed out shaft channel 31 and an upper 33 and a lower 34 end. A lateral bore 35 is provided at the lower end 34 to allow easy connection of the pull chain 36. The pull chain 36 is attached in a secure manner at its lower end to a central point 37 on the flapper valve 19 (see FIG. 1).

Referring to FIGS. 3 and 4, a cam slot 38 is provided at the upper end 33 of the shaft 32 that defines two opposing shaft extensions 39. The cam slot 38 is wide enough and long enough to allow a cam 40 to rotate unobstructed around a rivet 42 at the top of the shaft 32 between the shaft extensions 39. A pivot bore 43 extends through both shaft extensions 39 near the upper end of the shaft 32.

Referring to FIG. 2, the cam 40 has two similarly shaped opposing lobes. Lobe 40A assumes a downward facing position upon a long flush activation while lobe 40B assumes an upward position (see FIG. 6). A cam bore 41 is centrally located between the lobes. A rivet 42 extends through both the pivot bore 43 and cam bore 41 pinning the cam 40 for pivotal motion between the two shaft extensions 39. The cam 40 may be connected to the shaft 32 by any suitable means providing a secure attachment and allowing the cam 40 to pivot.

The cam 40 has a short flush linkage hole 44 and a long flush linkage hole near the lower edge 47. A cam projection 48 extends out from lobe 40A.

Referring to FIGS. 3 and 4, follower disk 49 is positioned along the shaft 32 directly below the cam 40. The follower disk 49 has two bores 50, each receiving one of the shaft extensions 39 so as to allow the follower disk 49 to longitudinally slide along the shaft extensions 39. A rigid bridge member 52 is provided between the follower bores 50 and forms an integral part of the follower 49. A follower guide 53 extends from the bridge member 52 axially downward and into the shaft channel 31 perpendicular to the follower disk 49. Loop 49A rides up and down on overflow tube 18.

The bridge member 52 limits rotational movement of the follower disk 49 by extending through the cam slot 38 and making limited contact with the shaft extensions 39. The follower guide 53 extends down through the shaft channel making limited contact with the shaft channel 31 to maintain the follower in a perpendicular orientation relative to the shaft 32. The follower disk 49 can be constructed of plastic, aluminum or another suitable rigid light weight material that provides little resistance to movement along the shaft extensions 39.

Referring to FIGS. 2, 3 and 4, a disk shaped float 54 is disposed under the follower disk 49. The float 54 has a single float bore 56 that receives the shaft 32 so as to allow longitudinal movement of the float 54 along the shaft 32. The float 54 should have a buoyancy so as to be able to maintain the flapper valve 19 above the seat 20 when the valve 19 is opened and the water is high in the tank.

A float stop 59 is disposed below the float 54 on the shaft 32. The float stop 59 extends radially outward from the shaft 32 further than the radius of float bore 56 to limit the longitudinal movement of the float 54 downward along the shaft 32. The float stop 59 serves to maintain the float 54 on the shaft 32 during both storage and shipping of the dual flush components as well as after installation.

Referring again to FIG. 1, first linkage 60 connects the short flush trip arm 25 to hole 44 along a nearly vertical connection line. Similarly, second linkage 61 connects the long flush trip arm 24 to the hole 46 along a relatively less vertical connection line. The different orientation of the connection lines and location of the flush holes 44, 46 produce different cam 40 motion upon activation in a manner to be described below.

Referring now to FIGS. 1 and 4, prior to activation of either handle 27, 28, the cam 40 can rest in a lateral position with its flat edge 62 in contact with the upper surface 63 of the follower 49. In this position, the float 54 and follower 49 are disposed at the upper end 33 of the shaft 32 and the flapper valve 19 is seated on the valve seat 20 in a closed position. The float 54 exerts a slight upward pressure on the cam 40, and thus maintains the cam 40 in its lateral position.

Referring next to FIGS. 1 and 5, upon activation of the first handle 27, the short flush trip arm 25 moves upward pulling the first linkage 60, which only partially rotates the cam 40 while simultaneously lifting the flapper valve 19 off its seat 20 into an open position.

The cam 40 having only rotated partially in response to the short flush activation succumbs to the upward pressure of the float 54 and quickly rocks back into its lateral position. The float 54 thus remains near the upper end 33 of the shaft 32, relatively high within the tank 10.

The flapper valve 19 remains in its open position being held up by the float 54. As water exits the tank 10 through the open outlet 14, the water level 65 drops. At some point the float 54 is no longer submerged and therefore the float 54 follows the water level 65 down allowing the flapper valve 19 to be reseated and to close the outlet 14. Because the float 54 is high within the tank 19, the dropping water level 65 reaches the float 54 relatively quick. Hence the float 54 begins to drop and lower flapper valve 19 relatively quickly. In this manner, a short flush is accomplished.

Figure 6:
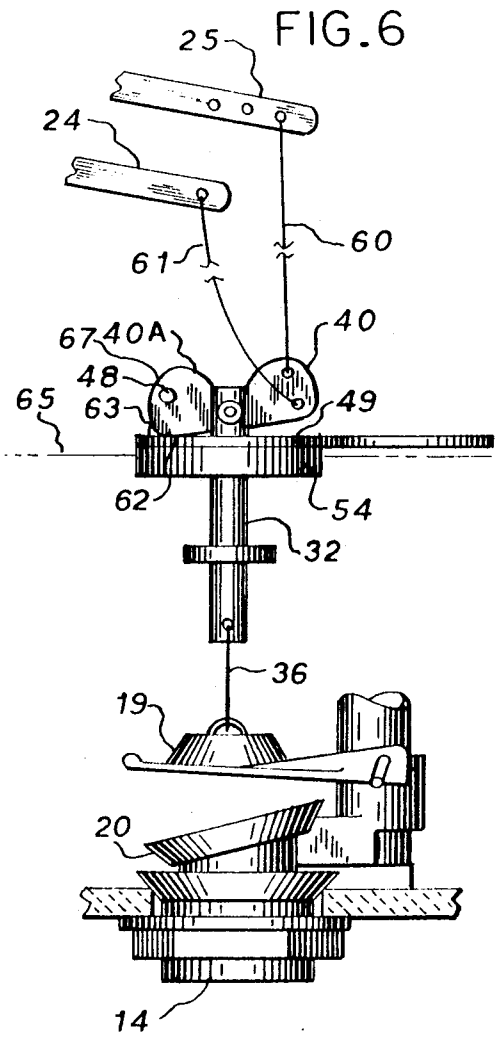
FIG. 6 is a schematic view of the flush mechanism in a short flush activated state.

Referring now to FIGS. 1 and 6, upon activation of the second handle 28, the long flush trip arm 24 moves upward pulling the second linkage 61. The angle at which a long flush activation pulls the cam 40 causes the cam 40 to rotate about 90° from its lateral position into a longitudinal position. Simultaneously, this lifts the flapper valve 19 off its seat 20 into an open position. The cam 40 rotates until the distal edge 67 of its lobe 40A is in contact with the upper surface 63 of the follower 49. Cam rotation is limited when the cam extension 48 contacts the shaft 32 (see FIG. 6). As the cam 40 rotates, it drives the follower 49 and float 54 longitudinally downward along the shaft 32. Referring to FIG. 3, the follower guide 53 cooperates with the shaft channel 31 to maintain the follower 49 perpendicular to the shaft 32 and hence the buoyant float 54 beneath the follower 49 also remains perpendicular to the shaft 32.

Referring again to FIG. 6, because the float 54 is relatively low within the tank 10, the receding water level 68 reaches the submerged level of the float 54 somewhat later, thereby allowing a greater volume of water to exit the tank 10 before the float 54 begins to drop and the flapper valve 19 is repositioned on its seat 20. In this manner, a long flush can be achieved using the present invention.

After a long flush, the cam 40 may remain in its longitudinal position. Upon another long flush activation, the cam 40 need not rotate. The upward pulling on the second linkage 61 is translated through the longitudinally positioned cam 40 and the pull chain 36 to lift the flapper valve 19 into an open position. The float 54 held low within the tank 10 by the longitudinally positioned cam 40 will again produce a long flush.

If a short flush is desired after an immediately preceding long flush, upon activation the short linkage 60 jerks the cam 40 and rotates it back toward the lateral position so that after rotation, the cam 40 assumes its lateral position (see FIG. 5).

FIGS. 8–10 show a second embodiment which is similarly numbered (except the B notations designate analogous parts). The primary differences are that the loop 49B is slightly smaller than loop 49A, follower 49B has no guide analogous to guide 53, holes 50B are rectangular for ease of molding (not arc-like), shaft 32B (see FIG. 9) is clothespin shaped and cam 40B is more boot-shaped than cam 40.

In addition to the specific embodiment shown, the invention can appear in other embodiments. For example, it is not critical that the follower 49 and the float 54 be separate components. One component may suffice. Nor is it critical that the lobes be similarly shaped. Thus, there may be various modifications and changes in embodiments which have been shown which are within the scope of the invention. Such modifications and changes are meant to be within the scope of the invention. As such, the invention is not to be limited by the illustrative description but should be judged by the scope of the following claims.

I claim:

1. A flush mechanism for use to permit selection between two different toilet tank flush cycles, the tank being of the type having a wall with an outlet therein and a non-buoyant valve member for opening and closing the outlet to control the level of fluid in the tank the flush mechanism comprising:

a shaft linked to said outlet valve;

a float slidably mounted on the shaft;

a cam pivotally connected to the shaft adjacent the float, the cam being rotatable between a short flush position wherein the cam allows the float to assume a high position along the shaft, and a long flush position wherein the cam member forces the float into a lower position along the shaft member;

a first linkage connected at a first location on said cam;

a second flush linkage connected at a second location on said cam;

a first activation means connected to the first flush linkage, the first activation means being capable of moving the first flush linkage thereby allowing the cam to assume a short flush position; and a second activation means connected to the second linkage, the second activation means being capable of moving the second linkage thereby moving the cam into a long flush position;

wherein said float being capable of retaining said non-buoyant valve member in an open position when said float is buoyant in the fluid.

2. The flush mechanism as recited in claim 1, further including a float stop disposed below the float on the shaft to limit the downward longitudinal movement of the float.

3. The flush mechanism as recited in claim 1, further including a cam projection positioned on the cam so as to contact the shaft member upon a long flush activation and thereby limit further rotation of the cam member.

4. The flush mechanism of claim 1, wherein a short flush activation of the cam will, if the last flush was a short flush, cause the cam to rotate in one direction and then automatically rock back in the opposite direction.

* * * * *